United States Patent [19]

Di Amico

[11] Patent Number: 5,062,211

[45] Date of Patent: Nov. 5, 1991

[54] MOTORIZED TWISTING PASTA FORK

[76] Inventor: Paul A. Di Amico, 500 E. Palm Canyon, Palm Springs, Calif. 92264

[21] Appl. No.: 664,122

[22] Filed: Mar. 4, 1991

[51] Int. Cl.[5] ..... A47J 43/28

[52] U.S. Cl. ..... 30/322

[58] Field of Search ..... 30/322, 323, 147, 148, 30/150, 206, 210, 228, 277.4, 264, 500; D7/653, 664, 393; 16/110 R

[56] References Cited

U.S. PATENT DOCUMENTS 3,589,009 6/1971 Mislavich et al. ..... 30/322

*Primary Examiner*—Douglas D. Watts

*Attorney, Agent, or Firm*—Roger A. Marrs

[57] ABSTRACT

A motorized dining fork is disclosed herein having an elongated hollow sleeve open at one end to insertably receive a shaft having a tined forked end. A battery-operated motor is mounted in the sleeve and forcibly rotates the shaft to twist the forked end. A gear reduction mechanism operably couples the motor drive shaft with the shaft of the forked end for controlled rotary movement effective to gather a pasta food product about the tines during an eating procedure. Bearing elements rotatably mount all turning shafts and control switches are employed to effect starting and stopping operations as well as RPM control.

1 Claim, 1 Drawing Sheet

MOTORIZED TWISTING PASTA FORK

BACKGROUND OF THE INVENTION

1. Field of the Invention

The present invention relates to the field of culinary equipment and more particularly to a novel motorized fork having the automatic ability to controllably twist while in the user's hand for the collection of a pasta food product thereon preparatory to eating the food.

2. Brief Description of the Prior Art

In the past, it has been the conventional practice to use a fork placed in the hand of the user whereby the user's hand is turned and twisted so as to gather food, such as spaghetti, pasta or the like onto the tines of the fork. Once the gathering has been completed, the fork is then lifted and the food consumed from its collected state on the end of the fork. The conventional fork includes an end carrying the tines and an elongated handle portion which is conveniently placed in the hand of the user. There is no separation or relative movement between the parts of the fork so that the only twisting motion is done by the wrist and hand of the user.

Although some attempts may have been made to employ an automatic twisting arrangement for the fork tines, problems and difficulties are oftentimes encountered which stem largely from the fact that the fork tines' turning or twisting movement is restricted while the user raises the implement to his mouth to consume the collected food. Obviously, once the twist has been made, the food must be retained on the fork tines and no twisting or turning or rotational movement may be tolerated while the implement is being raised to the mouth of the user. Otherwise, the collected food will bed dislodged, causing embarrassment to the user.

Automatic means for effecting twist or rotation of the fork tines should also include a means for releasably fixing the tines in a particular location so that collected food will not be so dislodged. Also, the rotation or twisting of the fork tines is oftentimes difficult on conventional forks inasmuch as the length of the tines is all the same so that an effective central pivot is not afforded to the implement. Furthermore, even prior devices which convert linear movement into rotary movement require manual plunging or pushing of the forked end into a plate of the food product. This procedure requires a visual coordination to follow collection of the food product on the forked end.

Therefore, a long-standing need has existed to provide an automatic means under motor control for turning the tined end of a fork so that manual operation of the turning and twisting of the forked end is avoided.

SUMMARY OF THE INVENTION

Accordingly, the above problems and difficulties are obviated by the present invention which provides a novel device for automatically gathering food, such as pasta, onto the tines of a fork and that will hold the food thereon during the eating procedure. Such a device includes an elongated shaft which is insertably received into the interior of a sleeve through an open end thereon. The shaft is driven, in one form, by a battery-operated motor housed in the sleeve. The exposed end of the shaft out of the sleeve includes a forked end having a plurality of tines whereby a central tine of the plurality is longer in length than the tines on the opposite sides thereof. Such longer tines provide a pivot whereby rotation of the forked end carrying the tines will readily rotate without binding or scraping. Control means are provided on the sleeve in operable relation to the motor and the shaft that cooperate to rotate the shaft with respect to the sleeve when food has been gathered thereon. Gear reduction means interconnect a motor drive shaft with the rotatable shaft.

Bearing means rotatably support the shaft on the sleeve and a storage compartment houses the battery, motor and control circuit and pertinent contacts.

Therefore, it is among the primary objects of the present invention to provide a novel motorized culinary fork capable of twisting and gathering food, such as pasta, that will automatically gather the food under push-button control and retain the food in place while the implement is being raised to the user's mouth.

Another object of the present invention is to provide novel motorized twisting fork tines for gathering food under the control of the user's hand via push button and which includes an electrical releasable means for preventing uncontrolled spinning or turning of the rotatable forked tine once food has been collected thereon.

Another object of the present invention is to provide an economic and convenient means for automatically gathering food via a battery-operated motor and control circuit onto the tines of a fork whereby the food may be readily consumed during a conventional culinary procedure.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
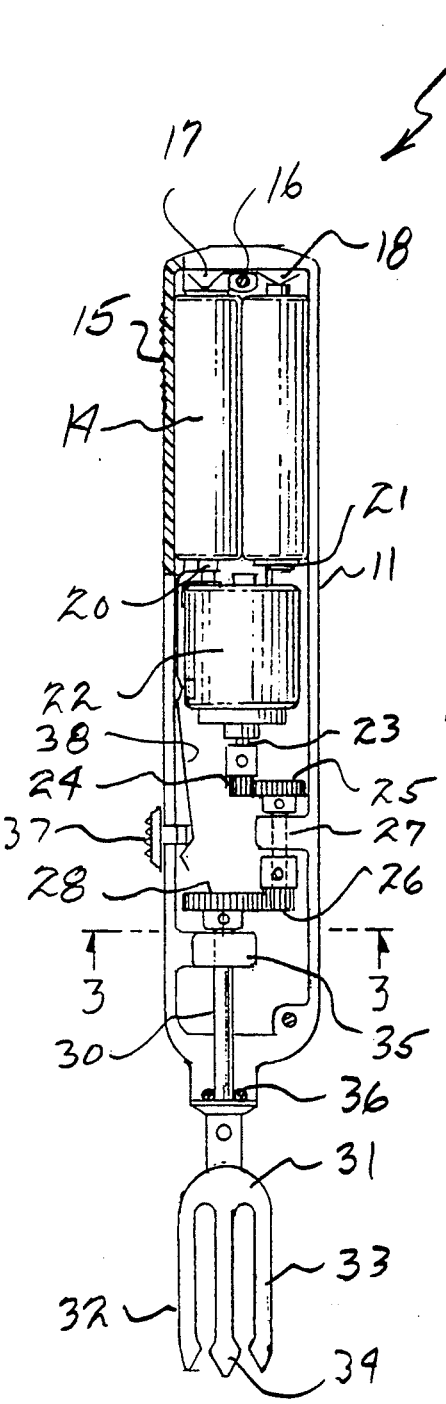
FIG. 1 is a front view, partly in section, of the novel fork without its cover incorporating the present invention.
Figure 2:
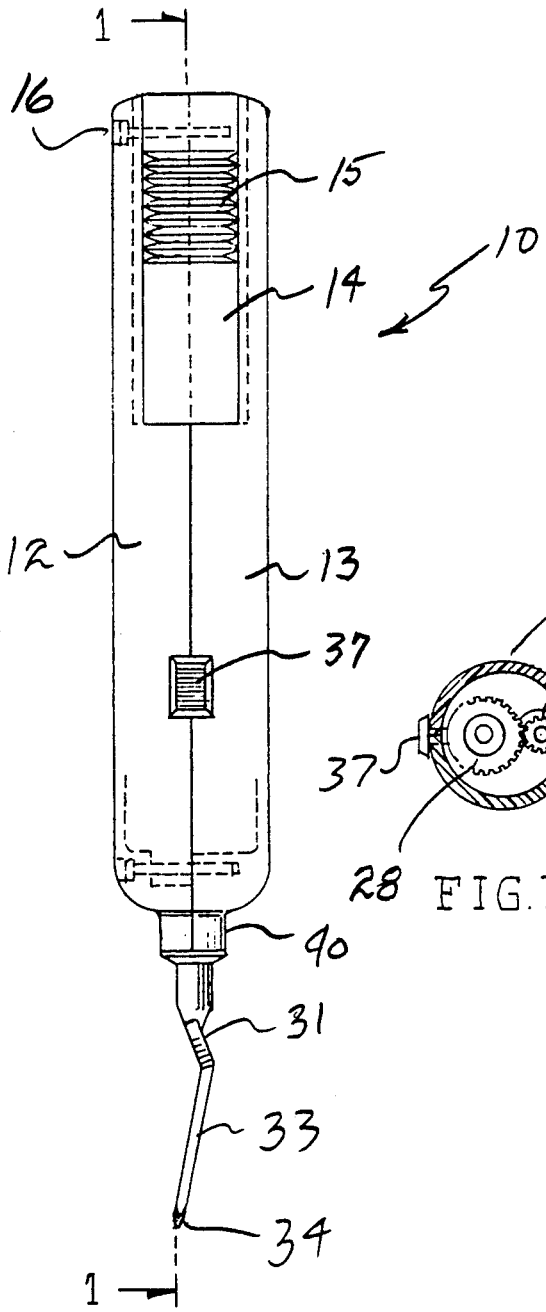
FIG. 2 is a view similar to the view of FIG. 1 illustrated the novel motorized fork.
Figure 3:
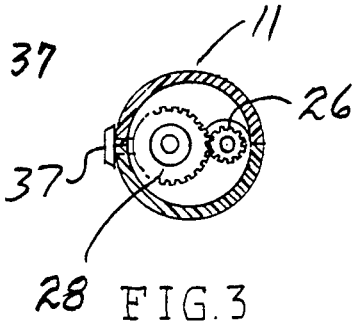
FIG. 3 is a transverse cross-sectional view of the motorized fork as taken in the direction of arrows 3—3 thereof.

Referring to FIGS. 1–3 inclusive, a motorized fork is indicated in the general direction of arrow 10 which includes an elongated housing 11 composed of two half portions, indicated by numerals 12 and 13, having alignable and mateable opposing edges which snaplock together in accordance with conventional procedure. One end of the sleeve 11 includes a storage compartment for housing a removable battery 14 via a pivoted panel 15 having thumb or finger grooves on its external surface. The panel 15 is hinged via a pivot 16 and includes electrical contacts 17 and 18 for receiving in engageable contact, terminals at one end of the batteries. The opposite ends of the batteries include additional contacts 20 and 21 which mate with contacts connected to a motor 22. The motor is included within a motor compartment of the sleeve 11 and includes a drive shaft 23 that terminates in a pinion gear 24 in contact with a gear reduction mechanism taking the form of gears 25 and 26 coupled on opposite ends of a shaft 27, and the mechanism further includes a ring gear 28. The ring gear 28 is carried on the end of a shaft 30 having its opposite end terminating in a forked arrangement of tines. The forked end is indicated by numeral 31, while the tines are indicated by numerals 32, 33 and 34 respectively. It is to be noted that the central tine 34 is longer than the tines on its opposite sides so as to form a pivoting point about which the outside tines will rotate during operation of the device. The shaft 30 is movably carried on the sleeve 11 by means of a pillow bearing 35 and a sealed bearing 36 at the extreme end of the sleeve.

Control means are provided for operating the motor 22 via a sliding or push-button switch 37 exposed externally of the sleeve 11 and operating via a spring contact 38.

It is to be noted in FIG. 2 that the cover is completely placed about the battery pack 14, the motor compartment 22 and the gear reduction mechanism so that dirt or foreign matter cannot interfere with the electrical or mechanical operation of the device. The sleeve 11 is composed of the halves or half portions 12 and 13 which are snapped together and the rotating fork end 31 protrudes from the end 40 of the sleeve, and the tines are offset from the central longitudinal axis of the sleeve. In other words, both ends of the forked end 31 lie on the central longitudinal axis of the sleeve, while the central portion of the forked end 31 protrudes or is offset from the central longitudinal axis. Such construction provides an improved means for collecting a food product such as pasta onto the forked end.

Therefore, it can be seen that the motorized fork of the present invention provides a static housing or sleeve 11 which is held by the hand of the user and the user may employ his fingers for actuating the switch 37 to energize the motor 22. Energization is provided by the power from the battery pack 14 and through the gear reduction mechanism, the forked end 31 is turned or rotated at a controllable speed. The user may elect to start and stop the turning operation at his convenience via the control switch 37. Also, speed may be readily controlled by selection of gear ratios and gear diameters employed in the gear reduction mechanism.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. An eating utensil for gathering food such as pasta, comprising:

a handle having a hollow sleeve composed of a pair of portions snap-locked together to define internal compartments;

a fork element having an elongated shaft insertably disposed within said sleeve in rotatable relationship therewith about the central longitudinal axis of said elongated sleeve;

motor means disposed within one of said internal compartments of said sleeve and operably coupled to said elongated shaft for providing turning power to drive said fork element in a rotary movement about said central longitudinal axis;

a plurality of elongated tines carried on said fork element in fixed spaced-apart relationship for collection of pasta thereon;

said motor means includes a motor having a drive shaft;

a gear reduction mechanism interconnecting said drive shaft with said fork element shaft;

a battery pack removably carried in another one of said internal compartments in electrical contact with said motor;

switch means carried on said sleeve for selectively supplying power from said battery pack to said motor;

said plurality of elongated tines includes a central tine separating adjacent tines in fixed spaced-apart relationship;

said central tine having one end integral with said shaft and its other end terminating in a tip; and said one end and said other end of said central tine lying on the central longitudinal axis of said sleeve and said central tine having a mid-portion between its opposite ends laterally offset from said central longitudinal axis.

* * * * *